United States Patent [19]

Everett

[11] Patent Number: 4,668,030

[45] **Date of Patent: * May 26, 1987**

[54] ADJUSTABLE CANOPY SUPPORT POST

[75] Inventor: Lynn E. Everett, New Philadelphia, Ohio

[73] Assignee: Tusco Manufacturing Co., Gnadenhutten, Ohio

[ * ] Notice: The portion of the term of this patent subsequent to Sep. 17, 2002 has been disclaimed.

[21] Appl. No.: 775,133

[22] Filed: Sep. 12, 1985

Related U.S. Application Data

[60] Division of Ser. No. 510,628, Jul. 5, 1983, Pat. No. 4,541,675, which is a continuation-in-part of Ser. No. 285,542, Jul. 21, 1981, abandoned.

[51] Int. Cl.[4] ..... A47B 45/00

[52] U.S. Cl. ..... 312/257 R

[58] Field of Search ..... 312/257 R; 248/297.2, 248/245; 211/94, 94.5

[56] References Cited

U.S. PATENT DOCUMENTS

| | | | |
|---|---|---|---|
| 3,143,981 | 8/1964 | Tassell | 248/297.2 |
| 3,905,712 | 9/1975 | McConnell | 211/208 |
| 4,541,675 | 9/1985 | Everett | 312/257 R |

*Primary Examiner*—Francis K. Zugel

*Assistant Examiner*—Joseph Falk

*Attorney, Agent, or Firm*—Marshall & Melhorn

[57] ABSTRACT

A canopy structure adapted to be disposed over a conventional display gondola and having a universal mounting device attachable to the top marginal edge of the gondola. The canopy includes a header assembly having adjustable panels, a rear panel and a front sign panel. The rear edge of the header is attached to the mounting device and the opposite edge is supported by posts extending upwardly from the bottom shelf of the gondola. The end panels each include a flange attached to a rear edge thereof for connection to one end of a vertically extending stud which is connected at its other end to the universal mounting device. In one embodiment, the stud and the flange both have apertures formed therein and fastening means are utilized to connect the stud to the flange while the stud is connected at its other end to stud bolts extending from the universal mounting device. In another embodiment, the studs are formed as inwardly flanged channel members attached at one end to the flange formed on the end panels. Outwardly extending channel members are attached to the universal mounting device and cooperate with the studs and a stud bolt. In both embodiments, the height of the header assembly can be adjusted by the positioning of the studs with respect to the universal mounting device.

4 Claims, 7 Drawing Figures

ADJUSTABLE CANOPY SUPPORT POST

CROSS-REFERENCE TO RELATED APPLICATION

This application is a divisional of co-pending application Ser. No. 510,628, filed July 5, 1983, now U.S. Pat. No. 4,541,675, which is a continuation-in-part of Ser. No. 285,542, now abandoned.

BACKGROUND OF THE INVENTION

1. Field of the Invention

This invention generally relates to canopies for display gondolas and, more particularly, to canopies including variable height support whereby a standardized canopy can be easily mounted on a variety of different size display gondolas.

2. Description of the Prior Art

Display of products for sale is a paramount problem with retailers, business and commercial establishments. The ever-attendant suppliers of merchandising systems have presented to the market-place a variety of display systems to attract and entice consumers. Many products are sold in mass merchandising outlets, food stores and the like and use specially designed display racks and/or gondolas with and without headers or canopies.

Many of the display systems available in the present market-place typically are of the gondola type which includes a perforated, vertical back panel or pegboard for displaying products. Such gondolas are manufactured by a multitude of companies in a variety of sizes. Thus it is desirable to produce a standardized canopy which has a rigid, inherently strong structure and is easy and economical to install as well as being rugged in use.

SUMMARY OF THE INVENTION

Specifically, the invention is directed to means for adjusting the height of the canopy to accommodate gondolas of different heights. A universal mounting means is attached to a top horizontally extending marginal edge of a vertical back panel of a gondola. A header assembly having a front panel, a rear panel and two end panels interconnected to form a ring-like structure is attached at the top end of two vertically extending studs which in turn are fastened to stud bolts extending from the mounting means. In one embodiment, the end panels have a flange formed on a rear edge thereof with a plurality of apertures formed therein. The studs have apertures formed therein for connection to the stud bolts and for connection to the end panel flanges with fasteners. In another embodiment, the studs are formed as inwardly flanged channel members which cooperate with the stud bolts and channel members on the mounting means.

BRIEF DESCRIPTION OF THE DRAWINGS

The above as well as other objects of the invention will become readily apparent to one skilled in the art from reading the following detailed description of a preferred embodiment of the invention when considered in the light of the accompanying drawings in which.

DETAILED DESCRIPTION OF THE PREFERRED EMBODIMENT

Figure 1:
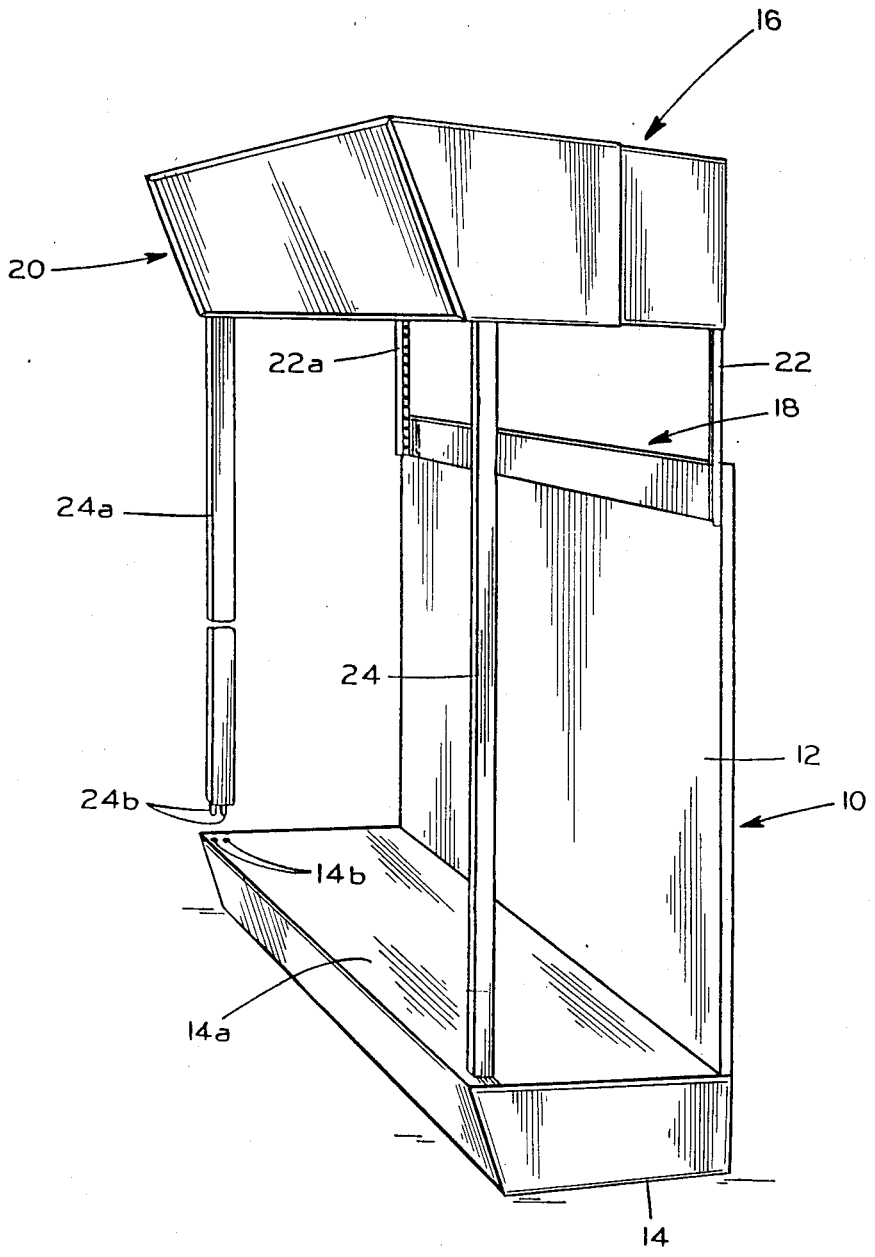
FIG. 1 is a perspective view of a single display gondola incorporating a canopy constructed in accordance with the invention.

Referring to the drawings wherein like reference numerals designate similar parts throughout, there is illustrated a typical gondola 10 including a back panel 12 extending vertically upwardly from the rear side of a bottom shelf 14.

Briefly, as illustrated in FIG. 1, a canopy 16 is adapted to be mounted on the top marginal edge of the back panel 12 by a universal mounting means 18. In addition to the mounting means 18, the canopy 16 generally includes a header assembly 20 supported by a pair of rear vertical mounting studs 22 and **22*a* and a pair of front posts 24 and 24*a* extending between the header assembly 20 and the top surface 14*a* of the bottom shelf 14**.

Figure 2:
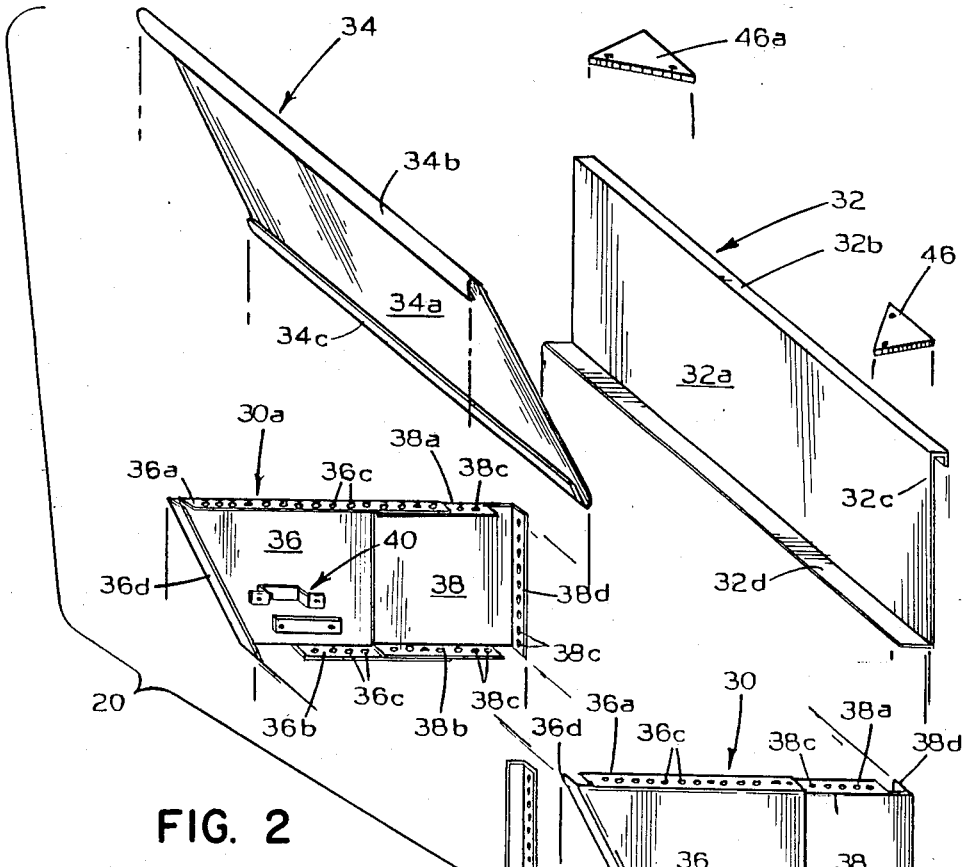
FIG. 2 is an exploded perspective view of the canopy illustrated in FIG. 1, showing the mounting strip in its overlapping position.
Figure 3:
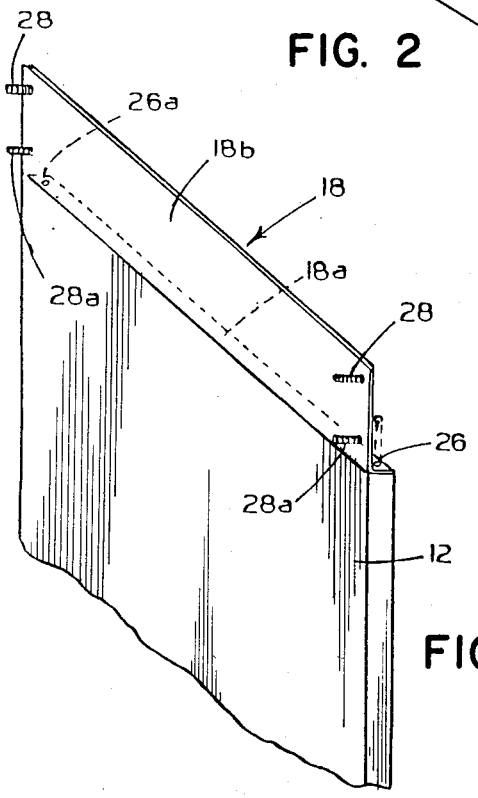
FIG. 3 is a fragmentary perspective view showing the mounting strip projecting above the top marginal edge.

Referring particularly to FIGS. 2 and 3, the universal mounting means 18 consists of a sheet metal strip generally L-shaped in cross-section having one flange portion **18*a* provided in which at least a pair of spaced apertures 26 and 26*a* may be produced and the other flange portion 18*b* having two pair of spaced threaded stud fasteners 28 and 28*a* projecting outwardly therefrom. The stud fasteners 28 and 28*a* are fixedly secured to the flange portion 18*b* as by tack welds (not shown). The flange portion 18*a* may be secured to the top marginal edge of the back panel 12** by sheet metal screws (not shown) or double face tape.

It will be noted in FIG. 2 that the flange **18*a* is set on the top marginal edge of the back panel 12 so that the flange 18*b* overlaps the surface 12*a* of the back panel 12. In FIG. 3, it will be noted that the flange 18*a* is set on the top marginal edge of the back panel 12 so that the flange 18*b* of the mounting means 18 projects upwardly from the top marginal edge of the back panel 12 thus providing more usable surface area of the back panel 12**.

Briefly, the header assemblage 20 includes right- and left-hand end panels 30 and **30*a*, respectively, which are mirror images of each other, a rear cover panel 32 and a front cover panel 34** all are interconnected to form a ring-like structure.

More particularly, each end panel 30 and **30*a* comprises a front flange section 36 and a rear telescoping flange section 38. The front section 36 includes upper and lower inwardly facing parallel flanges 36*a* and 36*b*, each being provided with a row of apertures 36*c*. Preferably, the outer front front edge of the front panel 36 is downwardly inclined and provided with an inwardly flange 36*d*. It will be noted that the lower flange 36*b* of the front section 36 is spaced from the flange 36*d* for receiving the post 24 or 24*a*. The post 24 or 24*a* is secured to the inside surface of the front section 36 by a flange clamping bracket 40 which may be secured to the front section as by tack welding. The clamping bracket 40 generally comprises a U-shaped bracket 40***a* having flanged ends 40*b* and includes a strap 42 which may be secured thereto as by wing nuts (not shown).

The telescoping rear section 38 is provided with upper and lower inwardly facing flanges 38*a* and and 38*b* with each flange being provided with a row of apertures 38*c* aligned with the apertures 36*c* of the flanges 36*a* and 36*b* of the front section 36. The vertically extending rear edge of the rear section 38 is provided with an inwardly facing flange 38*d* also having a row of apertures 38*c*, the purpose of which will be described hereinafter. The upper and lower flanges of the front and rear sections 36 and 38 of each end panel 30 and 30*a* are secured together in a desired depth relationship by conventional machine bolts (not shown). It will be noted that the lower flanges 38*b* of each rear section 38 is spaced from the flange 38*d* for receiving the rear mounting stud 22 and 22*a* extending upwardly from the back panel 12.

The rear cover panel 32 generally comprises an elongate panel 32*a* formed of sheet metal or the like, having an outwardly extending upper flange 32*b* provided with a depending lip 32*c* and a lower inwardly facing flange 32*d*. The upper flange 32*b* and its lip 32*c* are adapted to hang on the top marginal edges of the flange 38*d* of the rear sections 38.

The front cover panel 34, also formed of sheet metal or the like, generally comprises a center pane 34*a* having an upper, downwardly folded lip 34*b* and a lower, upwardly folded lip 34*c* for receiving display ads. Each open end of the lips 34*b* and 34*c* is adapted to engage the top and bottom portions of the flanges 36*d* of the front panels 36 of the end panels 30 and 30*a*.

The studs 22 and 22*a* each is an elongated member, angle shaped in cross section, wherein one flange 22*b* is provided with a row of apertures 22*c*, the apertures 22*c* being aligned with the apertures 38*c* in the flanges 38*d* of the rear panels 38 of the end panels 30 and 30*a* and with the studs 28*a* and 28*b* projecting from the mounting strip 18.

The bottom end of each front post 24 and 24*a* is provided with a pair of depending pins 24*b*, as illustrated in FIG. 1, which extend into cooperating apertures 14*b* provided in the top surface 14*a* of the shelf 14.

Figure 4:
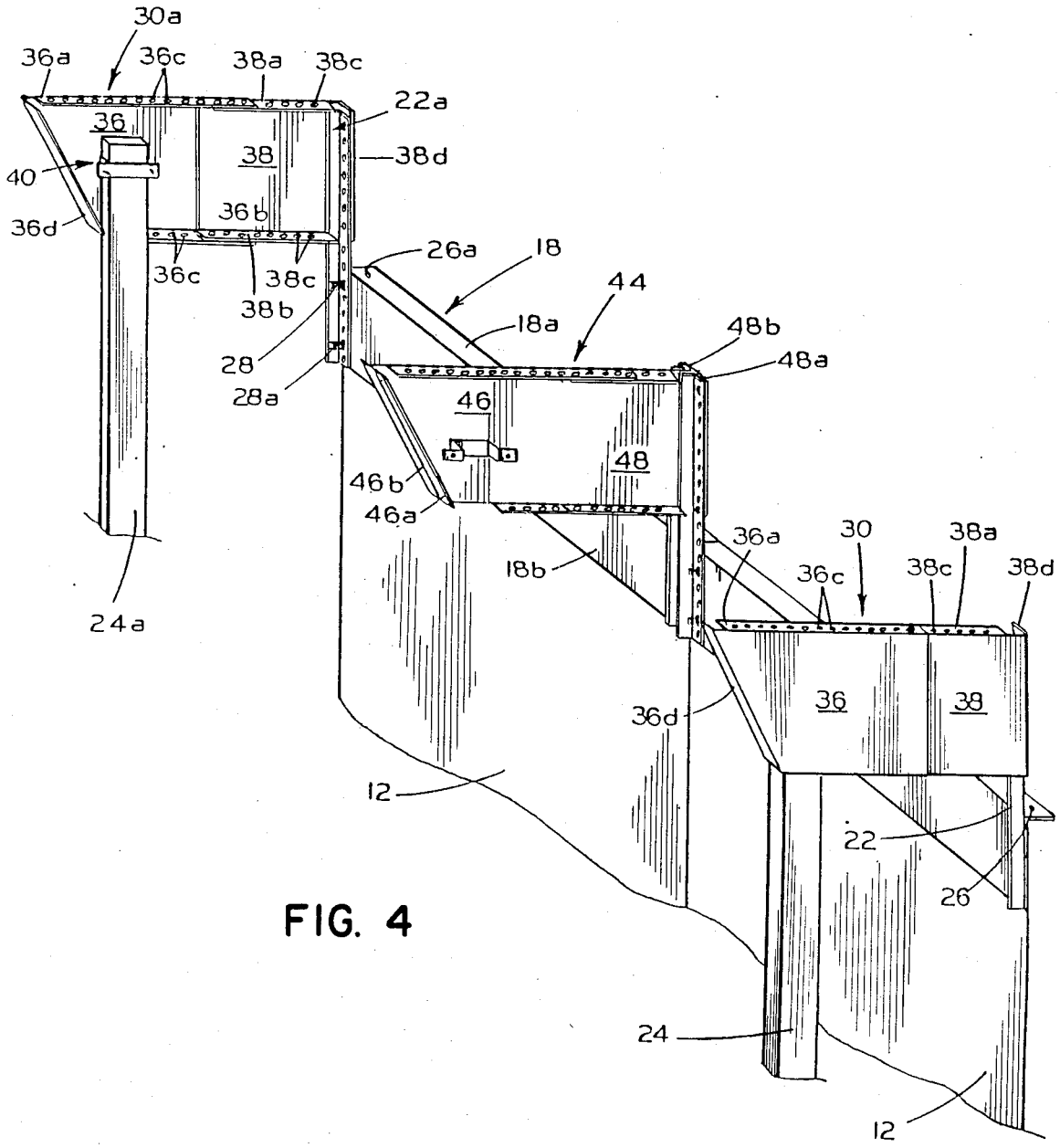
FIG. 4 is a fragmentary perspective view of another embodiment of the canopy installed on multiple gondola units.
Figures 5, 6, 7:
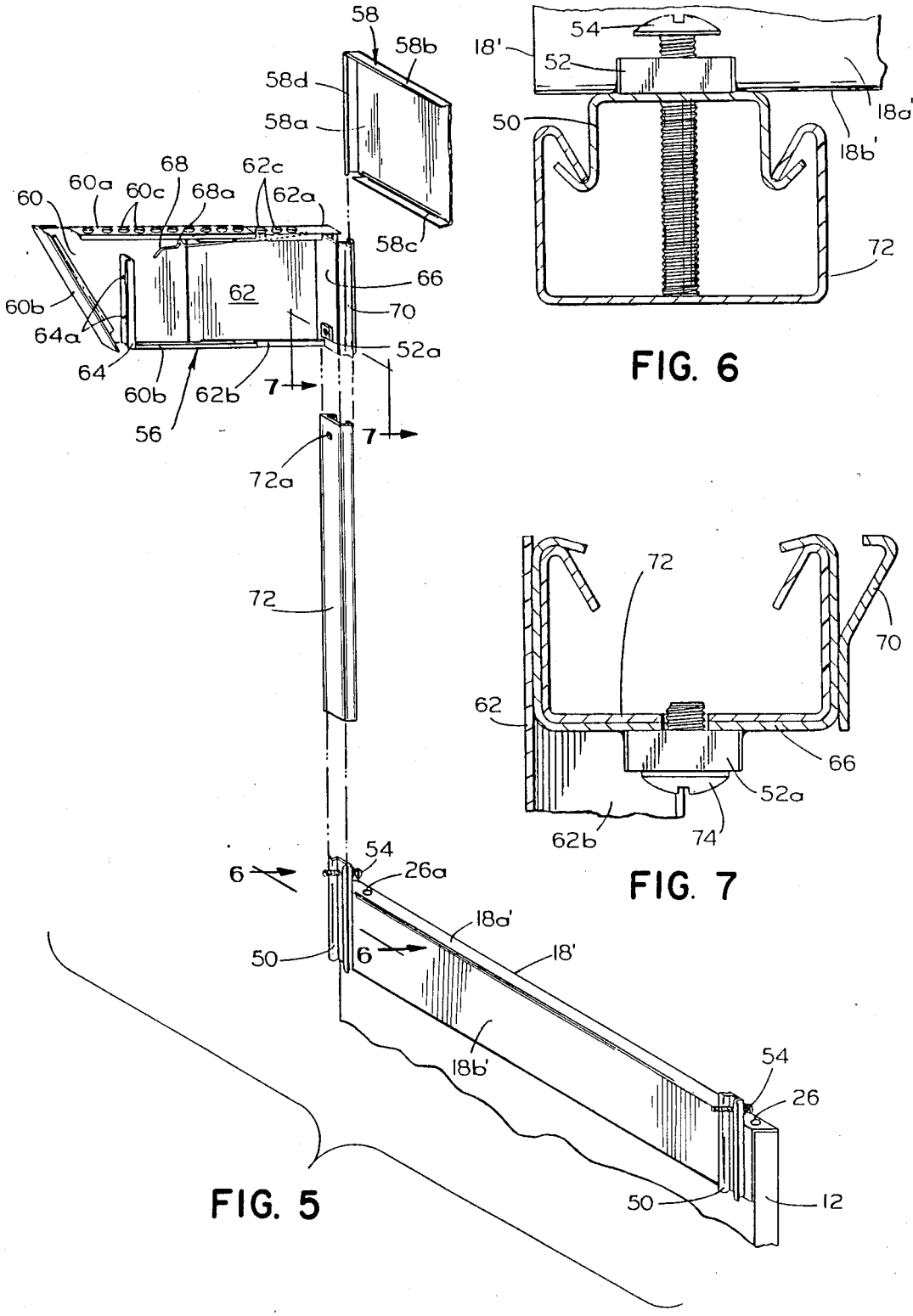
FIG. 5 is a fragmentary exploded perspective view of another embodiment of a canopy constructed in accordance with the invention.
FIG. 6 is a fragmentary cross-sectional view taken substantially along line 6—6 of FIG. 5.
FIG. 7 is a fragmentary cross-sectional view taken substantially along line 7—7 of FIG. 5.

In assemblying the canopy 16 on the gondola 10, the mounting means 18 or 18' is preferably placed on the top marginal edge of the panel 12 as illustrated in FIGS. 2 and 5, and secured thereto at each end by sheet metal screws (not shown) or by double face tape. If multiple units, as illustrated in FIG. 4, are employed, then the mounting means 18 or 18' are butted end-to-end when installed on the top marginal edge of the back panels. In this case one or more center panels 44 is employed. The center panel 44 includes a flange front section 46 and a rear flange section 48. These sections 46 and 48 are substantially similar to the corresponding end panel sections 32 and 34, except that vertically extending flanges extend from each side of the panels. More specifically, the front edge of the section 46 is provided with oppositely extending flanges 46*a* and 46*b*. Likewise, vertically extending flanges 48*a* and 48*b* extend from opposite sides of the rear edge of the section 48. Otherwise, the center panel 44 includes the same structural elements as previously described for the end panels 30 and 30*a*.

Each end of the flange portion 18*b'* of the L-shaped mounting means 18' includes an outwardly flanged channel member 50 which is attached, as by tack welding, to the front face of the flange portion 18*b'* in an upstanding position to extend above the flange portion 18*a*. The portion of the channel members 50 extending above the mounting means flange 18*a'* is provided with a weld nut 52 and bolt 54, the purpose of which will be described hereinafter. The mounting means 18' may be attached to the back panel 12 as previously described.

The header assemblage 20', in this embodiment of the invention, includes right- and left-hand end panels 56 and 56*a* (not shown), respectively, which are mirror images of each other, a rear cover panel 58 and a front cover panel (not shown) substantially the same as the previously described front cover panel 34.

More particularly, each end panel 56 and 56*a* comprises a front flange section 60 and a rear telescoping flange section 62. The front section 60 includes upper and lower inwardly facing parallel lip type flanges 60*a* and 60*b*, respectively, the upper flange 60*a* being provided with a row of apertures 60*c*. Preferably, the outer front edge of the front panel 60 is downwardly inclined and provided with an inwardly facing flange 60*d*. It will be noted that the lower flange 60*b* of the front section 60 is spaced from the flange 60*d* for receiving the post 24 or 24*a*. The post 24 or 24*a* is secured to the inside surface of the front section 60 by an upright flange strip bracket 64 which may be secured to the front section 60 as by tack welding. The strip bracket 64 includes at least two longitudinally spaced locking tabs 64*a* formed to project over the opening provided in the lower flange 60*b* for cooperating with complementary opening provided in the side of the adjacent post 24 or 24*a*.

The telescoping rear section 62 is provided with complementary upper and lower inwardly facing lip type flanges 62*a* and 62*b*, with the upper flange 62*a* being provided with a row of apertures 62*c* aligned with the apertures 60*c* of the flange 60*a* of the front section 60. The vertically extending rear edge of the rear section 62 is provided with an inwardly facing flange channel member 66 (see FIG. 7), the purpose of which will be described hereinafter. A spring loaded lever 68, one end of which has a locking tab 68*a* that is adapted to project into aligned apertures of the complementary upper flanges 60*a* and 62*a* has its other end affixed as by tack welding to the flange 62*a*. The lever 68 locks the front and rear sections 60 and 62 in a desired depth relation.

The rear cover panel 58 generally comprises an elongate panel 58*a* formed of sheet metal or the like, having an inwardly extending upper flange 58*b* and a lower inwardly facing flange 58*c*. The vertically extending edge of the panel 58*a* is provided with a rolled flange 58*d* for cooperating with a complementary flange member 70 affixed to the side of the channel member 66. The lower flange 58*c* is spaced from the rolled flange 58*d* while the upper flange 58*b* overlaps the rolled flange 58*d*, thus permitting the rear cover panel 58 to be connected to the rear panel section 62 of the end panel 56.

An inwardly flanged channel member 72 whose flanges are complementary to and cooperate with the flanges of the channel members 50 and 66 (see FIGS. 6 and 7) supports and connects the header assemblage 20' to the mounting means 18'. Referring to FIGS. 6 and 7, a weld nut 52*a* is affixed to the outer face of the channel member 66 and cooperates with an opening 72*a* provided in one end of the channel member 72 for receiving a bolt 74 for securing the members 66 and 72 to each other.

In all other aspects, the members employed in this embodiment of the invention are the same as those employed in the previously described embodiment.

When the header assemblage 20 is used, the rear studs 22 and 22*a* are attached to the studs 28 and 28*a* by nuts (not shown). It should be noted that the header assemblage 20 may be mounted directly on the mounting means 18 without the studs 22 and 22*a* that is, if the back panel 12 of the gondola 10 is of an appropriate height. The end panels 30 and 30*a* and the center panel or panels 44 are then attached to the studs 22 and 22*a* by machine nuts and bolts (not shown) extending through the apertures 38*c* aligned with the aperture 22*c* of the studs extending inside the flange portions 38*d*, 48*a* and 48*b*. As previously mentioned, the flange portions 38*d*, 48*a* and 48*b* may be attached directly to the mounting strips 28 and 28*a*.

When the header assemblage 20' is used, one end of the channel member 72 is telescoped over the channel member 50 as illustrated in FIG. 6 and the bolt 54 is rotated in a direction to clamp the flanges thereof against the complementary flanges of the channel member 50. The other end of the channel member 72 is telescoped within the channel member 66 of the rear panel section 62 of the end panel 56 and may be secured thereto by the bolt 74 being rotated in a direction to force the complementary flanges thereof against the complementary flanges of the channel member 66. On the other hand, bolt 74 can be inserted through an aperture provided in the channel member 72 to cooperate with the weld nut 52*a* provided on the channel member 66 to securely fasten the channel member 72 to the channel member 66.

The posts 24 and 24*a* are then either assembled in the clamp 40 as illustrated in FIG. 2, by wing bolts (not shown) or to the locking tabs 64*a* illustrated in FIG. 5, with the pins 24*b* of the posts inserted into the apertures 14*b* of the shelf 14.

In the embodiment shown in FIG. 2, the back panel 32 is assembled by hooking the flange 32*b* over the top edges of the flanges 38*d* and/or the flanges 48*a* and 48*b* of the end panels 30, 30*a* and/or 44. Corner braces 46 and 46*a* (see FIG. 2) may be secured to the top, marginal corner edges of the end panels 30, 30*a* and the adjacent portion of the flanges 32*b* for rigidly strengthening the canopy assembly. In the embodiment of the invention shown in FIG. 5, the rear cover panel 58 is assembled to the end panel 56 by sliding the flange portion 58*d* over the complementary flange of the member 70 until the upper flange 58*b* rests on the top marginal edge of the member 70.

The front side panel 34 is then assembled by sliding the open end of the lips 34*b* and 34*c* over the adjacent end portions of the flanges 36*d*. The header 20 is then adjusted so that all panels are level and the wing nuts are tightened. Desired ads are then installed in the front panel.

If desired, appropriate lighting fixtures may be mounted within the header assemblages 20 and 20' for illuminating and causing attention to be focused on the displayed products.

It will be appreciated from the foregoing description that the invention has resulted in a canopy for enhancing product displays which is comprised of a minimum number of components when the components can be installed quickly, economically and without the requirements of any particular expertise or tools or fasteners. Also, the canopy is one which can be easily removed and installed on other gondolas with the same ease as the initial installation.

In accordance with the patent statues, the principle and mode of operation of the invention has been explained and what is considered to represent its preferred embodiment has been illustrated and described. It should, however, be understood that the invention may be practiced otherwise than as specifically illustrated and described without departing from its spirit and scope.

What is claimed is:

1. A canopy for installation on a product display gondola having a bottom shelf and a back panel extending vertically upward from the rear side of the bottom shelf, said canopy comprising:

(a) a mounting means being generally L-shaped in cross-section with two flange portions, one flange portion attached to a top horizontally extending marginal edge of the back panel, the other flange portion extending generally parallel to the plane of the back panel and having at least one pair of spaced apart stud bolts extending outwardly therefrom;

(b) a header assembly disposed above the display gondola and comprising a rear panel, a front panel and two end panels which are interconnected to form a ring-like structure, each said end panel including a flange formed at a rear edge thereof;

(c) means for attaching the rear edges of said end panels to said mounting means including a pair of vertically extending studs spaced apart a distance approximately equal to the spacing of said pair of stud bolts, each said stud attached to a corresponding one of said end panel flanges and fastened on a corresponding one of said stud bolts of said mounting means, each said stud including adjustment means for cooperating with at least one of said end panel flange and said stud bolt for selectively positioning said header means at different heights above the display gondola; and (d) means for supporting the opposite edges of said end panels from the bottom shelf of the display gondola including means for adjusting the height of the opposite edges with respect to the display gondola.

2. The invention defined in claim 1 wherein said end panel flanges and said studs each include a plurality of apertures as said adjustment means whereby said stud bolts are selectively aligned with one of said apertures of the corresponding stud and another one of said apertures is selectively aligned with one of said apertures of said panel flanges to accept fastening means to adjust the height of said header assembly above the display gondola.

3. The invention defined in claim 11 wherein said mounting means has an outwardly facing channel member attached at each end thereof with said stud bolts extending through said channel members, each said outwardly facing channel member having generally outwardly extending flanges formed thereon, and wherein said vertically extending studs are inwardly facing channel members having generally inwardly extending flanges formed thereon complimentary to and cooperating with said outwardly extending flanges for sliding engagement therewith, said stud bolts being rotatably attached to said mounting means for engagement with said inwardly facing channel members whereby said inwardly facing channel members are forced away from said outwardly facing channel members and said inwardly and outwardly extending flanges abut to prevent relative vertical movement between said inwardly and outwardly facing channel members.

4. The invention defined in claim 1 wherein said means for supporting includes a pair of vertically extending posts each having one end resting on the bottom shelf of the display gondola and another end secured to a corresponding end panel by said means for adjusting and wherein said means for adjusting includes a flanged clamping bracket and cooperating strap attached to an inside surface of said end panel, said another end of said post extending between said bracket and said strap which cooperate to selectively clamp said end panel at any of a plurality of vertical positions with respect to said one end of said post.

* * * * *